US008820825B2

(12) United States Patent
Yang

(10) Patent No.: US 8,820,825 B2
(45) Date of Patent: Sep. 2, 2014

(54) SUPPORTING FRAME OF FOLDING CHAIR AND FOLDING CHAIR WITH ADJUSTABLE BACKREST

(71) Applicant: Zhejiang Hengfeng Top Leisure Co., Ltd., Zhejiang (CN)

(72) Inventor: Baoqing Yang, Hangzhou (CN)

(73) Assignee: Zhejiang Hengfeng Top Leisure Co., Ltd., Zhejiang (CN)

( * ) Notice: Subject to any disclaimer, the term of this patent is extended or adjusted under 35 U.S.C. 154(b) by 0 days.

(21) Appl. No.: 13/833,192

(22) Filed: Mar. 15, 2013

(65) Prior Publication Data

US 2014/0167473 A1 Jun. 19, 2014

(30) Foreign Application Priority Data

Dec. 18, 2012 (CN) ..... 2012 2 0703899 U

(51) Int. Cl.
*A47C 4/28* (2006.01)
*A47C 4/00* (2006.01)

(52) U.S. Cl.
USPC ..... 297/45; 297/21

(58) Field of Classification Search
USPC ..... 297/45, 52, 19, 21, 354.12
See application file for complete search history.

(56) References Cited

U.S. PATENT DOCUMENTS 2,704,569 A * 3/1955 Salzer ..... 160/378
5,882,068 A * 3/1999 Levine ..... 297/21
6,296,304 B1 * 10/2001 Zheng ..... 297/45
6,419,311 B1 * 7/2002 Tang ..... 297/45
6,951,327 B1 10/2005 Seo
2004/0245810 A1 * 12/2004 Tseng ..... 297/56
2010/0237664 A1 9/2010 Grace
2012/0175917 A1 7/2012 Chen

FOREIGN PATENT DOCUMENTS

CN 2115008 9/1992
CN 2677503 2/2005

OTHER PUBLICATIONS

European Patent Office, European Patent Search corresponding to International Application No. EP13151986.0—1656, Apr. 25, 2014, 5 pp.

* cited by examiner

*Primary Examiner* — Milton Nelson, Jr.
(74) *Attorney, Agent, or Firm* — Fitch, Even, Tabin & Flannery LLP

(57) ABSTRACT

The present application provides a supporting frame of a folding chair, including a frame body and backrest support rods arranged on two sides of the frame body. The backrest support rod includes a first support rod hingedly connected to a top connecting member of the frame body, a second support rod sleeved to the first support rod, a sliding sleeve hingedly connected to an end portion of the second support rod, and a return member arranged between the first support rod and the second support rod. The sliding sleeve is sleeved on a forward-tilting chair rod of the frame body. The present application further provides a folding chair with an adjustable backrest which allows the user to easily adjust the angle of the backrest when sitting on the folding chair.

10 Claims, 4 Drawing Sheets

SUPPORTING FRAME OF FOLDING CHAIR AND FOLDING CHAIR WITH ADJUSTABLE BACKREST

CROSS-REFERENCE TO RELATED APPLICATION

The present application claims the benefit of priority to Chinese patent application No. 201220703899.X titled "SUPPORTING FRAME OF FOLDING CHAIR AND FOLDING CHAIR WITH ADJUSTABLE BACKREST", filed with the Chinese State Intellectual Property Office on Dec. 18, 2012. The entire disclosure thereof is incorporated herein by reference.

FIELD OF THE INVENTION

The present application relates to the technical field of outdoor products, and in particular to a supporting frame of a folding chair and a folding chair with an adjustable backrest.

BACKGROUND OF THE INVENTION

A folding chair is an indispensable tool for outdoor activities, for example, outings or fishing.

A conventional folding chair provided with an adjustable backrest, as shown in FIGS. 1 to 2, generally includes a frame body 01, a backrest supporting rod 02, and a chair cushion 03.

The frame body 01 is formed by four pairs of chair rods, and the chair rods in each pair are articulated to form an X shape. Two chair rods of each pair are connected via an articulating shaft located at centers of both rod bodies, and two adjacent pairs of chair rods are hinged via a top connecting member or a bottom connecting member arranged at ends of the chair rods. Meanwhile, each pair of the chair rods located at two sides of the frame body 01 includes a forward-tilting chair rod 010 and a backward-tilting chair rod 011. A lower half section (from the articulating shaft in the center of the rod body to the end, connected to the bottom connecting member, of the rod body) of the forward-tilting chair rod 010 is provided with multiple locating holes 012, the top connecting member connected to the backward-tilting chair rod 011 is provided with a supporting rod hole 013, and the supporting rod hole 013 has a diameter larger than a diameter of the backrest supporting rod 02.

As shown in FIG. 2, an end of the backrest supporting rod 02 is hinged to a sliding sleeve 020 provided with a bolt 021, the sliding sleeve 020 is sleeved on the forward-tilting chair rod 010, and the bolt 021 can be inserted into the locating hole 012 so as to limit the sliding of the sliding sleeve 020 on the forward-tilting chair rod 010. The other end of the backrest supporting rod 02 passes through the supporting rod hole 013.

The chair cushion 03 includes a seat portion and a backrest portion. The seat portion is arranged on the frame body 01, and the backrest portion is arranged on the backrest supporting rod 02.

When using the above described folding chair, the user may adjust an angle of the chair backrest by adjusting the position of the sliding sleeve 020 on the forward-tilting chair rod 010.

However, when adjusting the backrest angle of the above folding chair, the user has to get up and leave the chair first, then pull out the bolt 021, and then manually adjust the angle of the backrest supporting rod 02, and finally use the bolt 021 to fix the position. The whole process is relatively complicated, and meanwhile requires the user to leave the chair to complete the adjustment, thus being very inconvenient.

From the above description, a technical problem to be solved presently by those skilled in the art is to provide a folding chair provided with a backrest, which allows the user to easily adjust the angle of the backrest without leaving the folding chair.

SUMMARY OF THE INVENTION

In view of this, the present application provides a supporting frame of a folding chair so as to realize as an objective that the user may easily adjust the angle of the backrest without leaving the folding chair.

In order to achieve the above objective, the present application provides the following technical solutions.

A supporting frame of a folding chair includes a frame body and backrest supporting rods arranged at two sides of the frame body, wherein each of the backrest supporting rods includes:

a first supporting rod hingedly connected to the frame body;

a second supporting rod sleeved to the first supporting rod;

a sliding sleeve sleeved on a forward-tilting chair rod of the frame body, and an end, which is not connected to the first supporting rod, of the second supporting rod is hingedly connected to the sliding sleeve; and a return member arranged between the first supporting rod and the second supporting rod.

Preferably, in the above described supporting frame, the first supporting rod is a hollow rod, and the return member is arranged in the first supporting rod.

Preferably, in the above described supporting frame, the second supporting rod is a hollow rod, and the return member is arranged in the second supporting rod.

Preferably, in the above described supporting frame, one of the first supporting rod and the second supporting rod is provided with a guiding groove, and the other of the first supporting rod and the second supporting rod is fixedly provided with a guiding rod cooperating with the guiding groove, and the guiding rod is slidably arranged in the guiding groove.

Preferably, in the above described supporting frame, the return member is a compression spring or a pneumatic rod.

Preferably, the above described supporting frame further includes a locking device arranged between the first supporting rod and the second supporting rod.

Preferably, in the above described supporting frame, the forward-tilting chair rod is provided with at least one fixing hole, and the sliding sleeve is provided with a bolt which can be inserted into the at least one fixing hole.

Preferably, in the above described supporting frame, the forward-tilting chair rod is provided with a position-limiting pin for limiting the movement range of the sliding sleeve.

Preferably, in the above described supporting frame, a top end of the first supporting rod bends towards an outside of the supporting frame.

The present application provides a supporting frame of a folding chair, which includes a frame body and backrest supporting rods arranged at two sides of the frame body. Each of the backrest supporting rods includes a first supporting rod hingedly connected to a top connecting member of the frame body, a second supporting rod sleeved to the first supporting rod, a sliding sleeve hingedly connected to an end of the second supporting rod, and a return member arranged between the first supporting rod and the second supporting rod. The sliding sleeve is sleeved on a forward-tilting chair rod of the frame body.

In the supporting frame according to the present application, the backrest supporting rod includes the first supporting rod and the second rod which are sleeved to one another. The first supporting rod is hingedly connected to the frame body, and the second supporting rod is slidably connected to the forward-tilting chair rod of the frame body via a sliding sleeve. Meanwhile, a return member is provided between the first supporting rod and the second supporting rod. After the supporting frame according to the present application is used in a folding chair, when a user leans backward with his back, the first supporting rod swings backward and drives the second supporting rod to swing synchronously, the sliding sleeve slides along the forward-tilting chair rod, and meanwhile, the return member is compressed. When the user leans forward with his body, the return member drives the first supporting rod, the second supporting rod and the sliding sleeve back to their original positions, such that the backrest of the folding chair is restored to the original state.

From the above description, by using the supporting frame according to the present application on the folding chair, the user may easily adjust the angle of the backrest when sitting on the folding chair.

The present application further provides a folding chair with an adjustable backrest including the above described supporting frame and a chair cushion arranged on the supporting frame.

BRIEF DESCRIPTION OF THE DRAWINGS

For more clearly illustrating embodiments of the present application or the technical solutions in the prior art, drawings referred to describe the embodiments or the prior art will be briefly described hereinafter. The drawings in the following description are only several embodiments of the present application, and for the person skilled in the art, other drawings may be obtained based on these drawings without any creative efforts.

Figure 1:
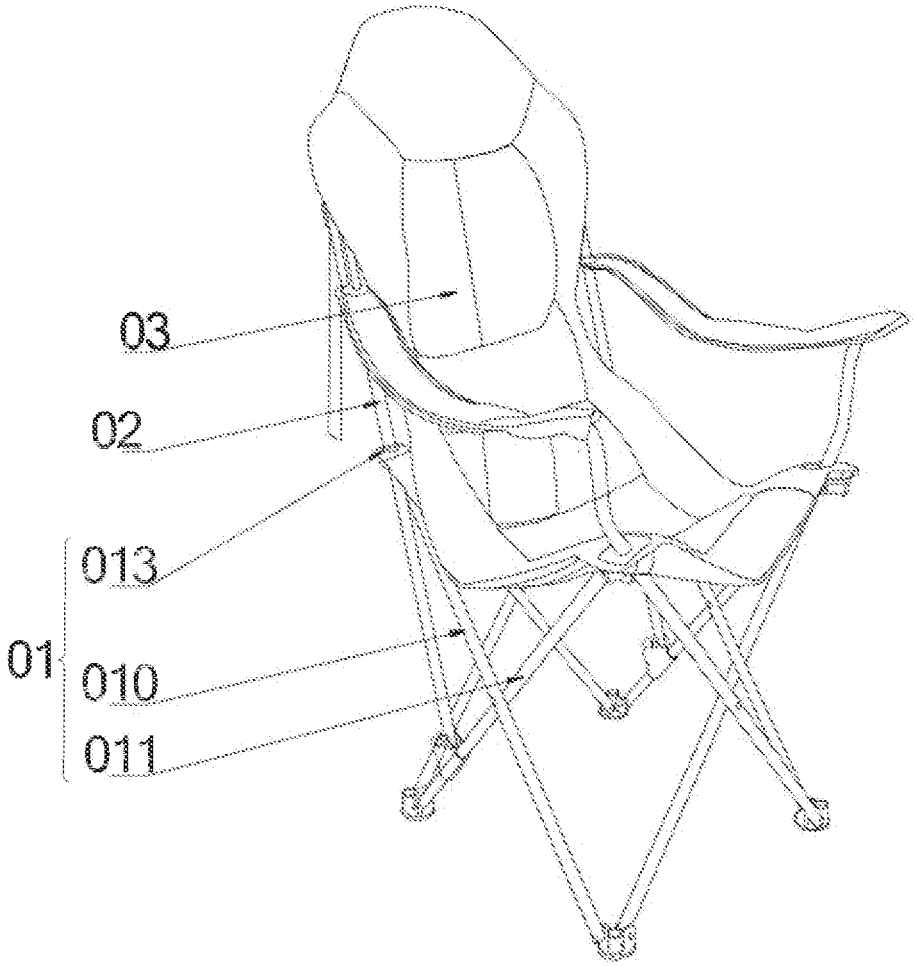
FIG. 1 is a schematic view of the structure of a conventional folding chair.
Figure 2:
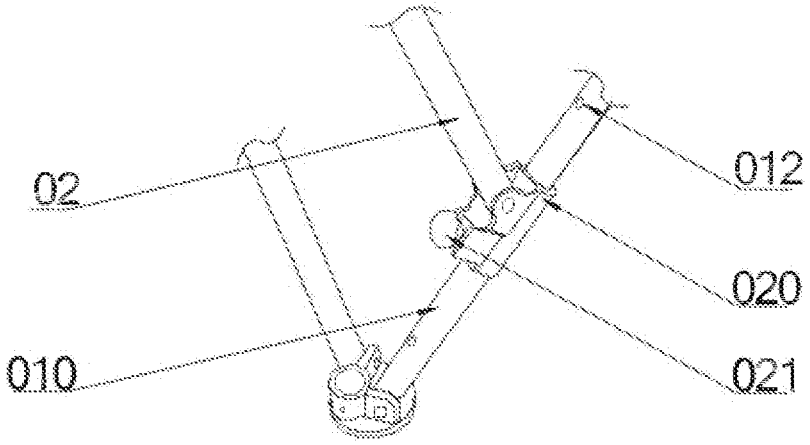
FIG. 2 is a partial structural schematic view of a connecting portion of a frame body and a backrest supporting rod in the conventional folding chair.

Reference numerals in the above FIGS. 1 to 6:

01 frame body,
02 backrest supporting rod,
03 chair cushion,
010 forward-tilting chair rod,
011 backward-tilting chair rod,
012 locating hole,
013 supporting rod hole,
020 sliding sleeve,
021 bolt;
1 frame body,
2 backrest supporting rod,
10 forward-tilting chair rod,
11 backward-tilting chair rod,
20 first supporting rod,
21 second supporting rod,
22 sliding sleeve,
23 return member,
24 guiding groove,
25 guiding rod, and
26 position-limiting pin.

DETAILED DESCRIPTION OF THE INVENTION

Embodiments of the present application provide a supporting frame of a folding chair for realizing as an objective that the user may easily adjust the angle of the backrest without leaving the folding chair.

The technical solutions in the embodiments of the present application will be described clearly and completely hereinafter in conjunction with the drawings in the embodiments of the present application. The described embodiments are only a part of the embodiments of the present application, rather than all embodiments. Based on the embodiments in the present application, all of the other embodiments, made by the person skilled in the art without any creative efforts, fall within the protective scope of the present application.

Figure 3:
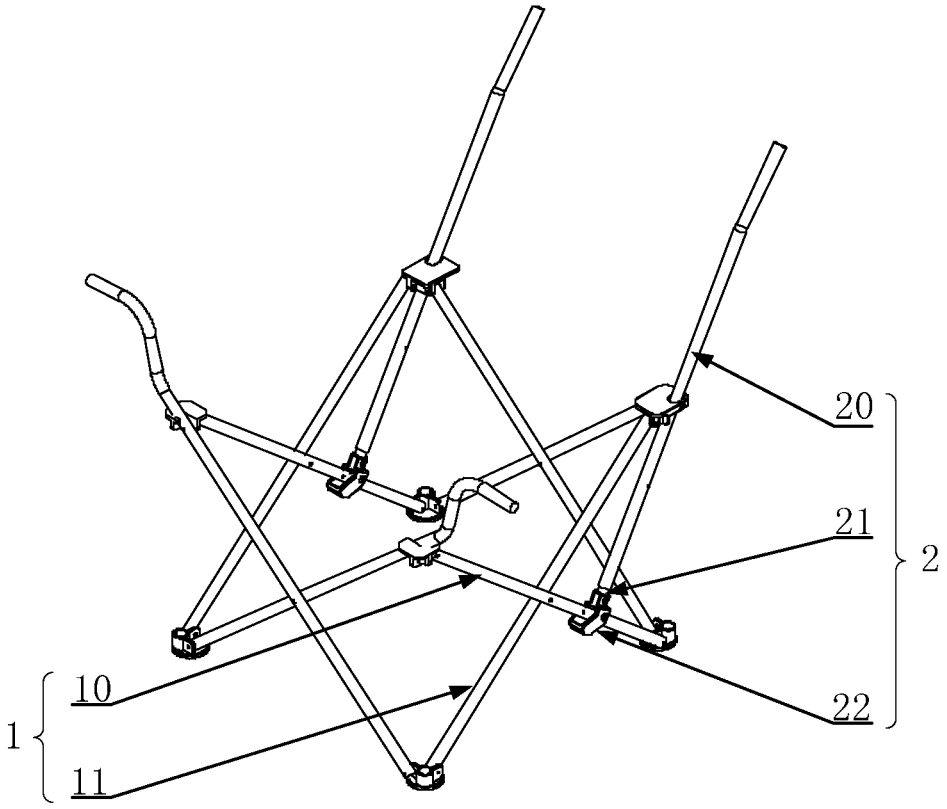
FIG. 3 is a schematic view of the structure of a supporting frame according to an embodiment of the present application.
Figure 4:
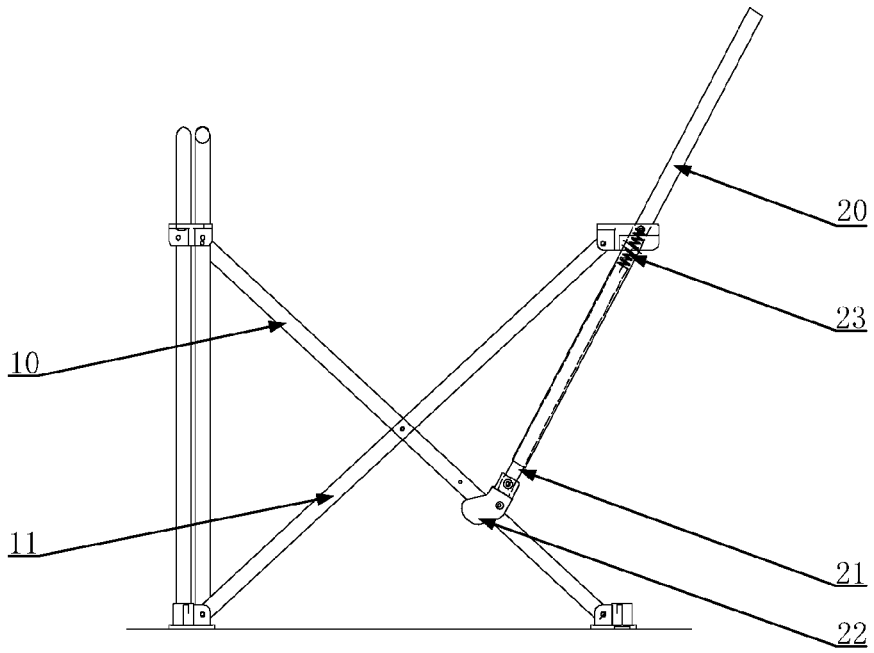
FIG. 4 is a schematic view showing the connecting relationship of a return member in the supporting frame.

Referring to FIGS. 3 to 4, the supporting frame according to embodiments of the present application includes a frame body 1 and a backrest supporting rod 2.

It can be appreciated that, the frame body 1 is formed by four pairs of chair rods, the chair rods in each pair are articulated to form an X shape, two chair rods of each pair are connected via an articulating shaft located at centers of both rod bodies, and two adjacent pairs of chair rods are hinged via a top connecting member or a bottom connecting member arranged at the ends of the chair rods. Each pair of the chair rods located at two sides of the frame body 1 includes a forward-tilting chair rod 10 and a backward-tilting chair rod 11.

The backrest supporting rod 2 includes a first supporting rod 20 and a second supporting rod 21 which are sleeved to one another. At least one of the first supporting rod 20 and the second supporting rod 21 is a hollow rod, wherein the first supporting rod 20 may have a larger diameter, and the second supporting rod 21 is sleeved in the first supporting rod 20; or the second supporting rod 21 may have a larger diameter, and the first supporting rod 20 is sleeved in the second supporting rod 21. The first supporting rod is hingedly connected to the frame body.

The backrest supporting rod 2 further includes a sliding sleeve 22 and a return member 23. The sliding sleeve 22 is sleeved on the forward-tilting chair rod 10 and is located between a central articulating shaft and a lower end of the forward-tilting chair rod 10. Meanwhile, an end of the second supporting rod 21 which is not connected to the first supporting rod 20, is hingedly connected to the sliding sleeve 22. The return member 23 is arranged between the first supporting rod 20 and the second supporting rod 21. It can be appreciated that, the return member 23 is arranged inside one of the first supporting rod 20 and the second supporting rod 21 which has a larger diameter, and the return member 23 abuts against the first supporting rod 20 and the second supporting rod 21 so as to fix the position.

After the supporting frame according to the present embodiment is used in a folding chair, when a user leans backward with his back, the first supporting rod 20 swings backward and drives the second supporting rod 21 to swing synchronously, the sliding sleeve 22 slides along the forward-tilting chair rod 10, and meanwhile, the return member 23 is compressed. When the user leans forward with his body, the return member 23 drives the first supporting rod 20, the second supporting rod 21 and the sliding sleeve 22 back to their original positions, such that the backrest of the folding chair is restored to the original state.

From the above description, by using the supporting frame according to the present application on the folding chair, the user may easily adjust the angle of the backrest when sitting on the folding chair.

Figure 5:
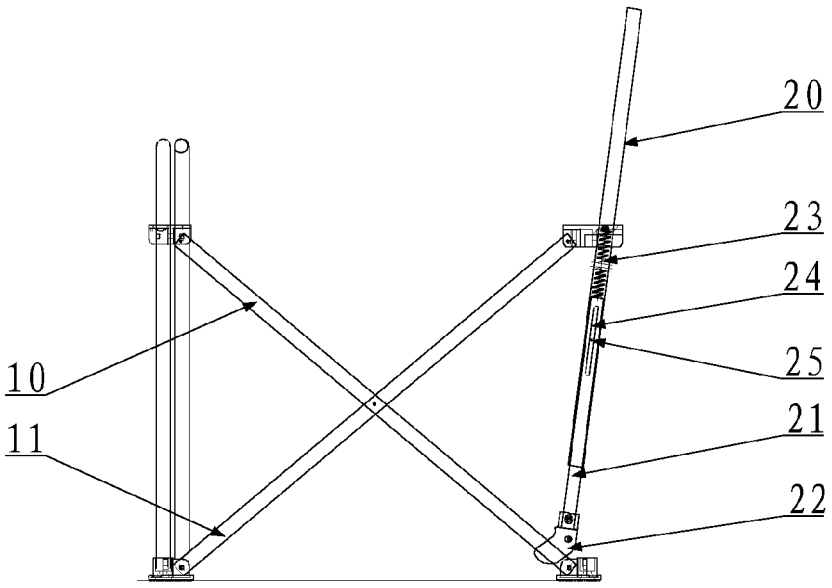
FIG. 5 is a schematic view of the structure of the supporting frame provided with a guiding groove and a guiding rod.

Referring to FIG. 5, in order to ensure that the first supporting rod 20 and second supporting rod 21 which are sleeved to one another have a more stable structure when they are sliding telescopically, on the basis of the above embodiment, the supporting frame according to the present embodiment is further provided with a guiding groove 24 and a guiding rod 25. The guiding groove 24 and the guiding rod 25 are respectively arranged on the first supporting rod 20 and the second supporting rod 21, and the guiding groove 24 and the guiding rod 25 can cooperate with each other, i.e. the guiding rod 25 has a diameter equal to or proximately equal to a width of the guiding groove 24, such that the guiding rod 25 is slidably arranged in the guiding groove 24.

The guiding groove 24 and the guiding rod 25 may serve a guiding function when the first supporting rod 20 and the second supporting rod 21 are sliding with respect to each other, such that the supporting rod 2 may have a more stable structure.

Specifically, in the supporting frame according to the above embodiments, the return member 23 may be an elastic member which can restore to the original state after being compressed, such as a compression spring, or a pneumatic rod.

After adjusting the backrest of the folding chair at a relatively comfortable angle, the user may naturally hope the folding chair can be maintained in this state automatically. In order to achieve this object, based on the above embodiments, another supporting frame according to the present embodiment is further provided with a fixing hole and a bolt.

A surface of the forward-tilting chair rod 10 is provided with multiple fixing holes distributed in a length direction of the forward-tilting chair rod 10. Meanwhile, the sliding sleeve 22 is provided with a bolt which can cooperate with the fixing holes. After properly adjusting the angle of the supporting rod 2, the user may fix the supporting rod 2 by inserting the bolt into the nearest fixing hole to fix the sliding sleeve 22, thereby realizing the object of fixing the backrest angle of the folding chair.

Figure 6:
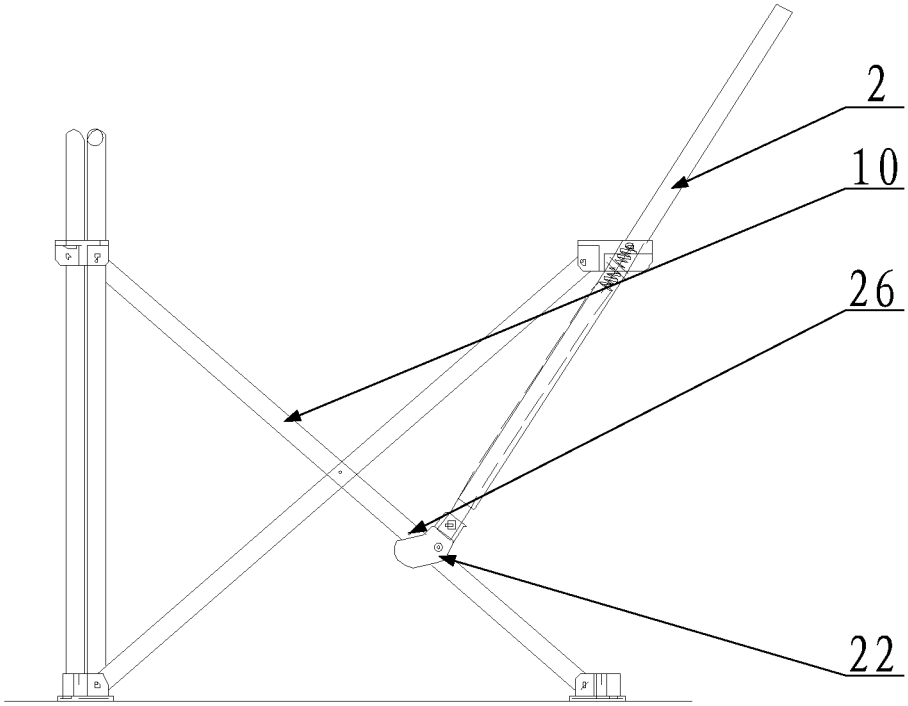
FIG. 6 is a schematic view of a position-limiting pin in the supporting frame according to the embodiment of the present application.

In the supporting frame according to the above embodiments, if the supporting rod 2 is tilted backward excessively, the backrest of the folding chair may be tilted backward excessively, which may be undesirable. In order to solve the problem, the supporting frame according to another embodiment of the present application further includes a position-limiting pin 26 for limiting the angle of the supporting rod 2. Referring to FIG. 6, the position-limiting pin 26 is arranged on the forward-tilting chair rod 10, and specifically is located at one side, closer to a bottom end of chair rod 10, of the middle articulating shaft. When moving to the above position, the sliding sleeve 22 will be stopped by the position-limiting pin 26 and cannot slide forward anymore, which prevents the supporting rod 2 from continuing to swing backward, thereby limiting the backward-tilting angle of the backrest of the folding chair.

Preferably, in the supporting frame according to the above embodiments, a top end of the first supporting rod 20 bends towards an outside of the supporting frame. It can be seen that, by configuring the top end of the first supporting rod 20 bending backward, after the chair cushion is mounted, a top end of the chair cushion also bends backward, such that the chair cushion may more closely fit the curve of the user's back and provides a more comfortable feeling for the user.

The embodiments of the present application further provide a folding chair with an adjustable backrest including the above described supporting frame and a chair cushion arranged on the supporting frame.

By using the above supporting frame, the folding chair according to the present embodiment allows the user to easily adjust the angle of the backrest without leaving the folding chair.

The above embodiments are described in a progressive manner. Each of the embodiments is mainly focused on describing its differences from other embodiments, and references may be made among these embodiments with respect to the same or similar portions among these embodiments.

Based on the above description of the disclosed embodiments, the person skilled in the art is capable of carrying out or using the present application. It is obvious for the person skilled in the art to make many modifications to these embodiments. The general principle defined herein may be applied to other embodiments without departing from the spirit or scope of the present application. Therefore, the present application is not limited to the embodiments illustrated herein, but should be defined by the broadest scope consistent with the principle and novel features disclosed herein.

The invention claimed is:

1. A supporting frame of a folding chair, comprising a frame body and backrest supporting rods arranged at two sides of the frame body, wherein each of the backrest supporting rods comprises:

a first supporting rod hingedly connected to the frame body;

a second supporting rod sleeved to the first supporting rod;

a sliding sleeve sleeved on a forward-tilting chair rod of the frame body, and an end, which is not connected to the first supporting rod, of the second supporting rod is hingedly connected to the sliding sleeve; and a return member arranged between the first supporting rod and the second supporting rod.

2. The supporting frame according to claim 1, wherein the forward-tilting chair rod is provided with at least one fixing hole, and the sliding sleeve is provided with a bolt which can be inserted into the at least one fixing hole.

3. The supporting frame according to claim 1, wherein the forward-tilting chair rod is provided with a position-limiting pin for limiting the movement range of the sliding sleeve.

4. The supporting frame according to claim 1, wherein a top end of the first supporting rod bends towards an outside of the supporting frame.

5. A folding chair with an adjustable backrest, comprising a supporting frame and a chair cushion arranged on the supporting frame, wherein the supporting frame is the supporting frame according to claim 1.

6. The supporting frame according to claim 1, wherein the return member is a compression spring or a pneumatic rod.

7. The supporting frame according to claim 1, wherein the first supporting rod is a hollow rod, and the return member is arranged in the first supporting rod.

8. The supporting frame according to claim 7, wherein one of the first supporting rod and the second supporting rod is provided with a guiding groove, and the other of the first supporting rod and the second supporting rod is fixedly provided with a guiding rod cooperating with the guiding groove, and the guiding rod is slidably arranged in the guiding groove.

9. The supporting frame according to claim 1, wherein the second supporting rod is a hollow rod, and the return member is arranged in the second supporting rod.

10. The supporting frame according to claim 9, wherein one of the first supporting rod and the second supporting rod is provided with a guiding groove, and the other of the first supporting rod and the second supporting rod is fixedly provided with a guiding rod cooperating with the guiding groove, and the guiding rod is slidably arranged in the guiding groove.

* * * * *